US007243889B1

(12) United States Patent
Lopez-Torres, Jr.

(10) Patent No.: US 7,243,889 B1
(45) Date of Patent: Jul. 17, 2007

(54) FLUSH VALVE MOUNTED HOLDER

(76) Inventor: Augusto Lopez-Torres, Jr., 11 W. Harvard St., Orlando, FL (US) 32804

( * ) Notice: Subject to any disclaimer, the term of this patent is extended or adjusted under 35 U.S.C. 154(b) by 0 days.

(21) Appl. No.: 11/331,515

(22) Filed: Jan. 13, 2006

Related U.S. Application Data

(60) Provisional application No. 60/707,601, filed on Aug. 12, 2005.

(51) Int. Cl.
*A47F 5/00* (2006.01)

(52) U.S. Cl. ..... 248/310; 248/311.2; 248/314; 248/346.11; 4/301; 220/737

(58) Field of Classification Search ..... 248/311.2, 248/310, 314, 346.01, 346.11, 346.5, 219.2, 248/146; 4/661, 301; 220/737; 422/102; 215/393, 394; 206/426, 433, 502, 593; D7/624.1, D7/524, 537
See application file for complete search history.

(56) References Cited

U.S. PATENT DOCUMENTS 3,672,514 A * 6/1972 Tucker ..... 211/73
4,860,895 A * 8/1989 Iaslovits ..... 206/426
5,964,444 A * 10/1999 Guertler ..... 248/548
6,243,885 B1 * 6/2001 Lopez-Torres, Jr. ..... 4/300
6,273,005 B1 * 8/2001 Wehrmeyer ..... 108/42
6,869,055 B2 * 3/2005 Casiello, Jr. ..... 248/346.11
7,096,521 B2 * 8/2006 Rifkin ..... 4/661
2003/0168565 A1 * 9/2003 Casiello ..... 248/346.11
2004/0177434 A1 * 9/2004 Sputh ..... 4/301
2006/0143822 A1 * 7/2006 Kelley ..... 4/661

* cited by examiner

*Primary Examiner*—Korie Chan
(74) *Attorney, Agent, or Firm*—Allen, Dyer, Duppell, Milbrath & Gilchrist, P.A.

(57) ABSTRACT

A holder adapted for mounting on a flush valve housing, said holder including a body having a lower portion and an upper portion; a connector having a side wall forming at least part of the lower portion of said body, said connector dimensioned to engage the flush valve housing and having a flange adapted to make frictional contact therewith; a holder having a side wall forming at least part of the upper portion of said body, said holder providing a receptacle for holding an item; at least a first support forming a division between said connector and said holder to support an item placed in said holder; and one or more threaded fasteners positioned on the lower portion of said body to enhance the frictional contact.

3 Claims, 6 Drawing Sheets

FLUSH VALVE MOUNTED HOLDER

RELATED APPLICATION

This application claims priority from now abandoned provisional application Ser. No. 60/707,601, which was filed on Aug. 12, 2005, and Ser. No. 60/738,165 which was filed on Nov. 18, 2005, both of which are incorporated herein by reference in their entirety.

FIELD OF THE INVENTION

The present invention relates to the field of beverage holders and, more particularly, to a drink caddy which mounts to the housing of a flush valve typically used with commercial sanitary fixtures.

BACKGROUND OF THE INVENTION

Commercial sanitary fixtures such as urinals and toilets are in widespread use. These fixtures are installed in buildings and facilities where large groups of people often congregate for sporting events, concerts, conferences, and other gatherings. In addition, these fixtures are also commonly found in eating and drinking establishments such as restaurants, bars and nightclubs.

The public attending crowded events such as football games, or visiting a concert facility or nightclub, will eventually visit the restroom where these fixtures are installed. Many times, a person will be carrying a drink container of some kind, a cup, bottle or glass, for which the person will need to find a safe resting place while the person uses the toilet or urinal. Commonly, the person may try to balance the beverage container upon the edge of the sanitary fixture or on the associated plumbing, often resulting in a spilled drink, or broken bottle, and liquid and glass covering the floor of the restroom. Such spills create highly unsafe conditions for all patrons, and frustration for the patron who accidentally spills his/her beverage in that manner.

SUMMARY OF THE INVENTION

With the foregoing in mind, the present invention advantageously provides a holder adapted for mounting on a flush valve housing. The present holder comprises a body having a lower portion and an upper portion. A connector having a side wall forms at least part of the lower portion of said body and is preferably dimensioned to engage the flush valve housing with a flange adapted to make frictional contact therewith. The holder also has a side wall forming at least part of the upper portion of said body, said holder providing a receptacle for holding an item. At least a first support is positioned forming a division between said connector and said holder to support an item placed in said holder. One or more threaded fasteners are positioned on the lower portion of said body to enhance the frictional contact.

Another embodiment of the present holder provides a flush valve mounted beverage caddy. The caddy includes a generally cylindrical body having a lower portion and an upper portion. A beverage holder having a side wall forming a mouth and a cavity forms the upper portion of said cylindrical body and having a flange along an outer lower periphery of said beverage holder. A connector has separable curved members associated with the lower portion of said cylindrical body, said connector having a first flange for engaging the flange on said beverage holder and a second flange for making frictional contact with the valve housing.

A base is positioned between the connector and the beverage holder, said base providing a support for a beverage container placed in said beverage holder. In this embodiment, one or more fasteners associated with said connector to aid in enhancing the frictional contact.

A further embodiment of the present invention includes a flush valve mounted beverage caddy comprising a generally cylindrical body having an upper portion defining a caddy for holding a beverage and having a lower portion defining a flush valve connector. A first base extends across a diameter of said cylindrical body separating the upper portion from the lower portion. A second base extends across a diameter of the upper portion of said cylindrical body, said second base being spaced apart from said first base and having a cutout extending from an outer periphery to a center of said second base. A first wall extends upwardly along a periphery of the upper portion of said generally cylindrical body, said first wall having an opening aligned with the cutout in said second base and extending upwardly along the wall. A second wall extends downwardly along a periphery of the lower portion of said generally cylindrical body, said second wall forming a cavity wherein to matingly receive a flush valve housing. One or more fasteners are associated with said lower portion.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
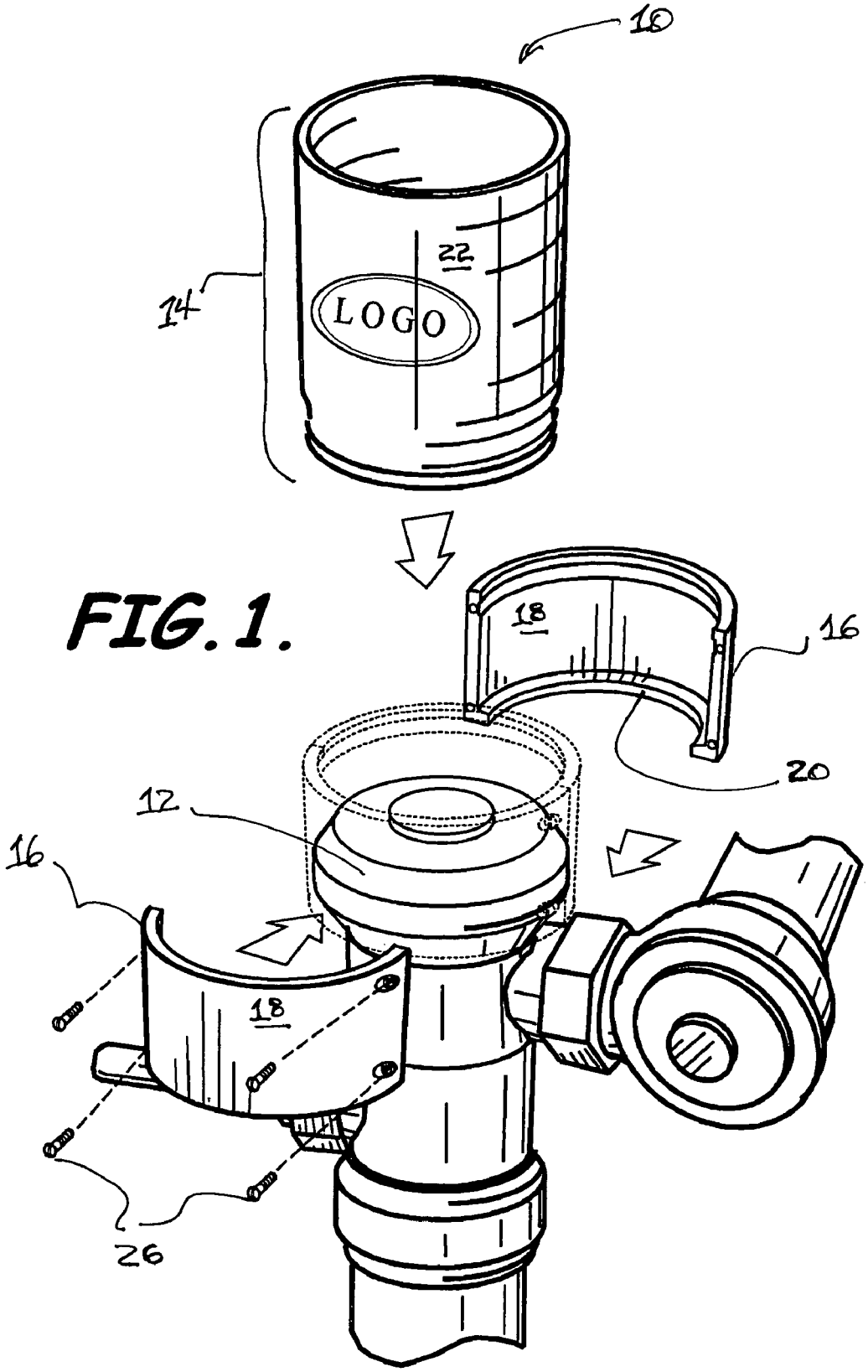
FIG. 1 is an exploded perspective view showing the flush valve mounted beverage caddy having separable connector members, according to an embodiment of the present invention.
Figure 2:
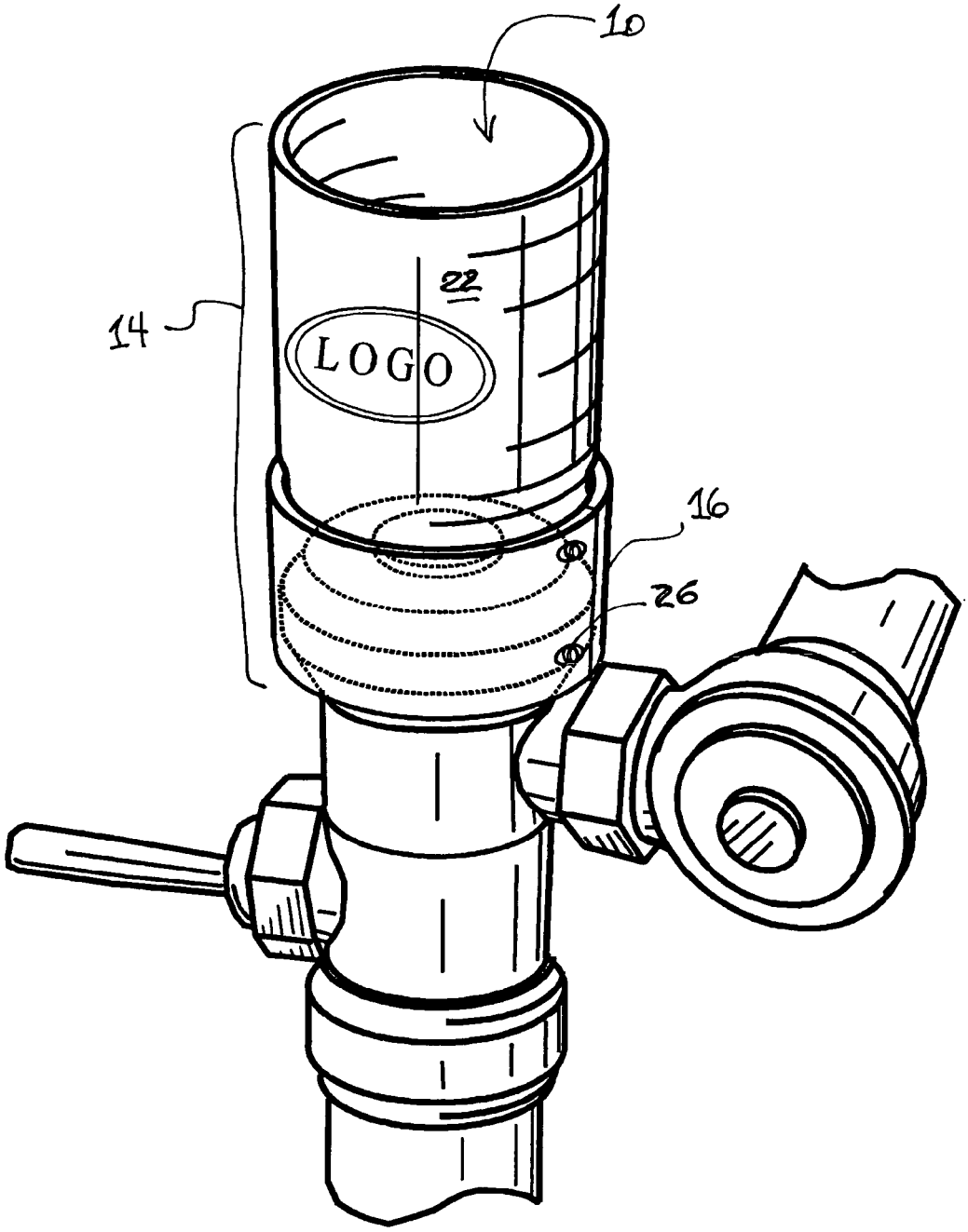
FIG. 2 shows the caddy of FIG. 1 mounted on the flush valve housing.
Figure 3:
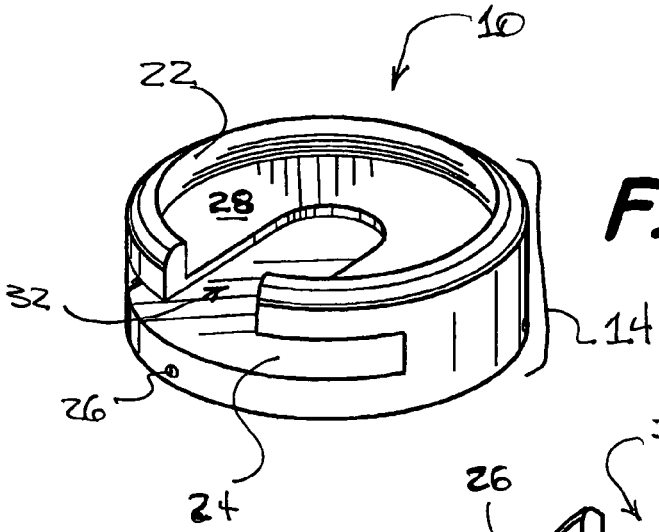
FIG. 3 depicts a top perspective view of a second embodiment of the caddy of the present invention, wherein a double-base includes a slot permitting secure holding of stemmed glasses.

FIGS. 1 through 10 illustrate various embodiments of the flush valve mounted beverage caddy herein disclosed. Two principal embodiments of the present invention are shown in the figures and described herein. In particular, FIGS. 1-2 show the first principal embodiment and FIGS. 3-10 show the second embodiment. Both these embodiments share certain common features and are intended within the overall scope of the invention.

Figure 4:
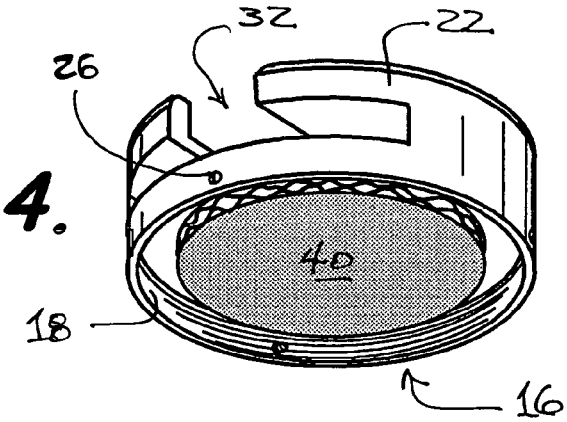
FIG. 4, provides a bottom perspective view of the caddy of FIG. 3.
Figure 5:
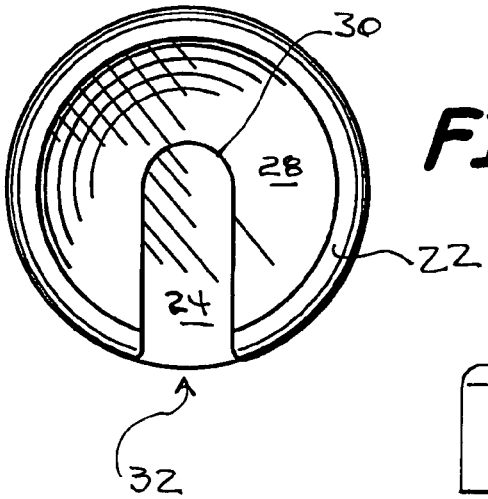
FIG. 5 is a top plan view of the caddy of FIG. 4.
Figure 6:
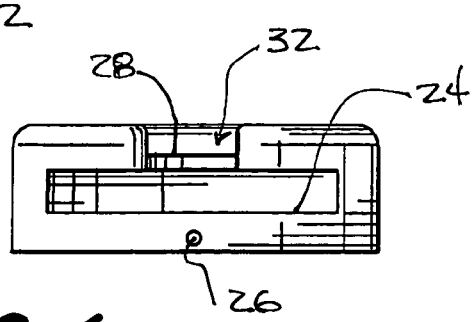
FIG. 6 shows a side elevation of the caddy of FIG. 4.
Figure 7:
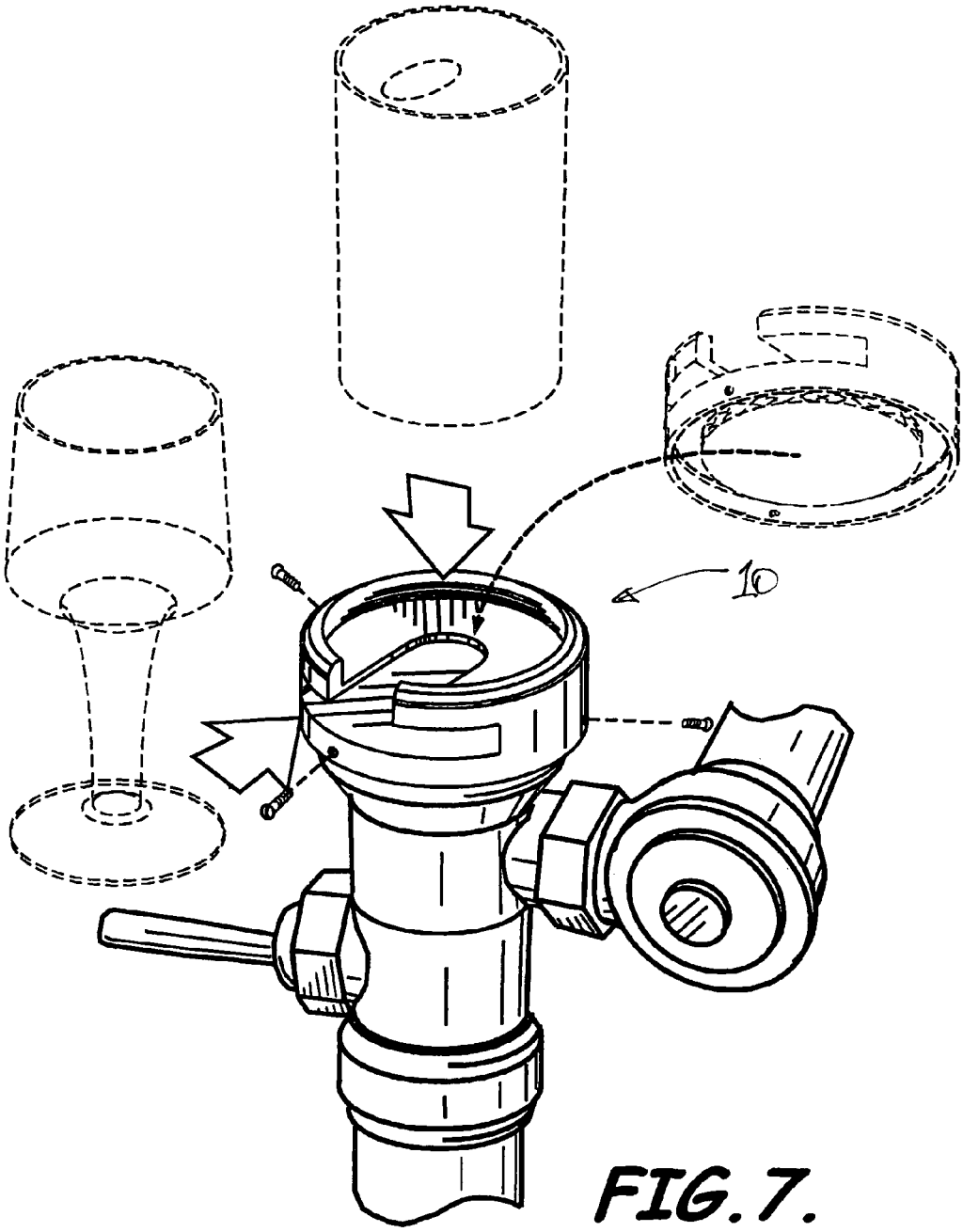
FIG. 7 illustrates the mounting and operation of the caddy of FIG. 3.
Figure 8:
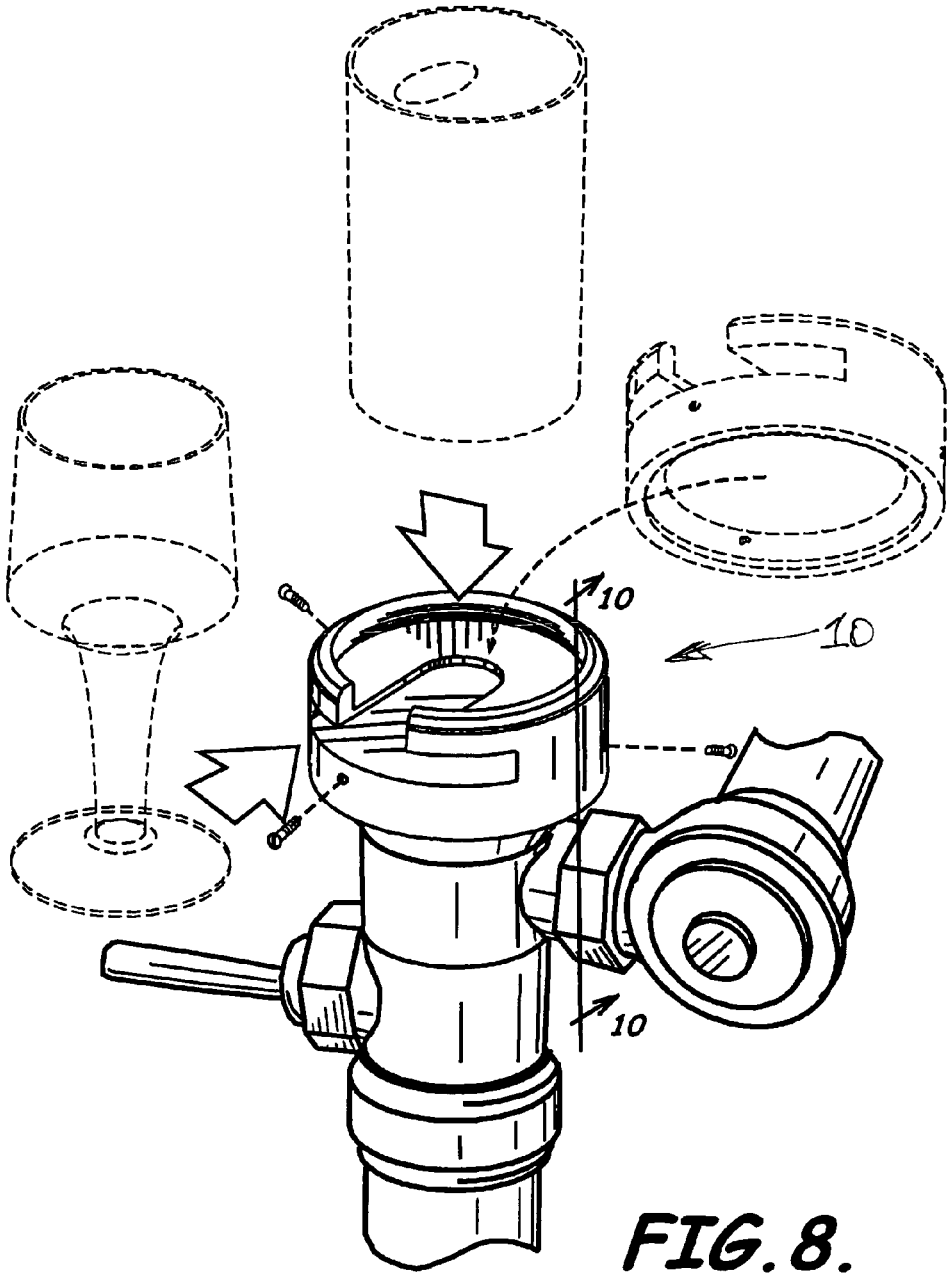
FIG. 8 is a perspective environmental view of an alternate embodiment of the caddy of FIG. 3, having a deeper cavity for engaging the flush valve housing.
Figure 9:
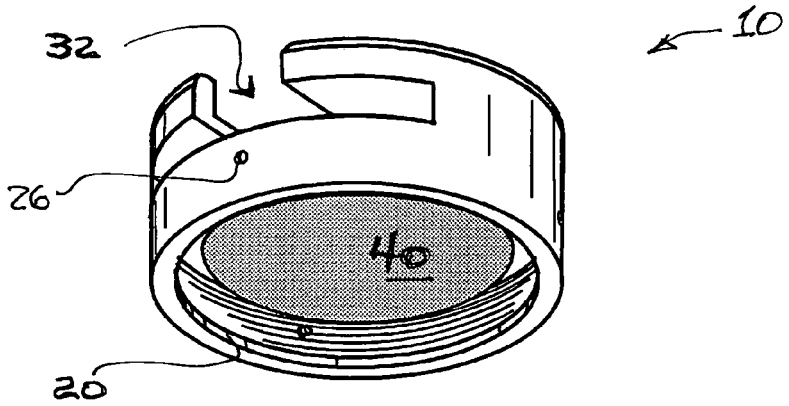
FIG. 9 shows a bottom perspective view of the caddy of FIG. 8, wherein the flange in the connector member is visible.
Figure 10:
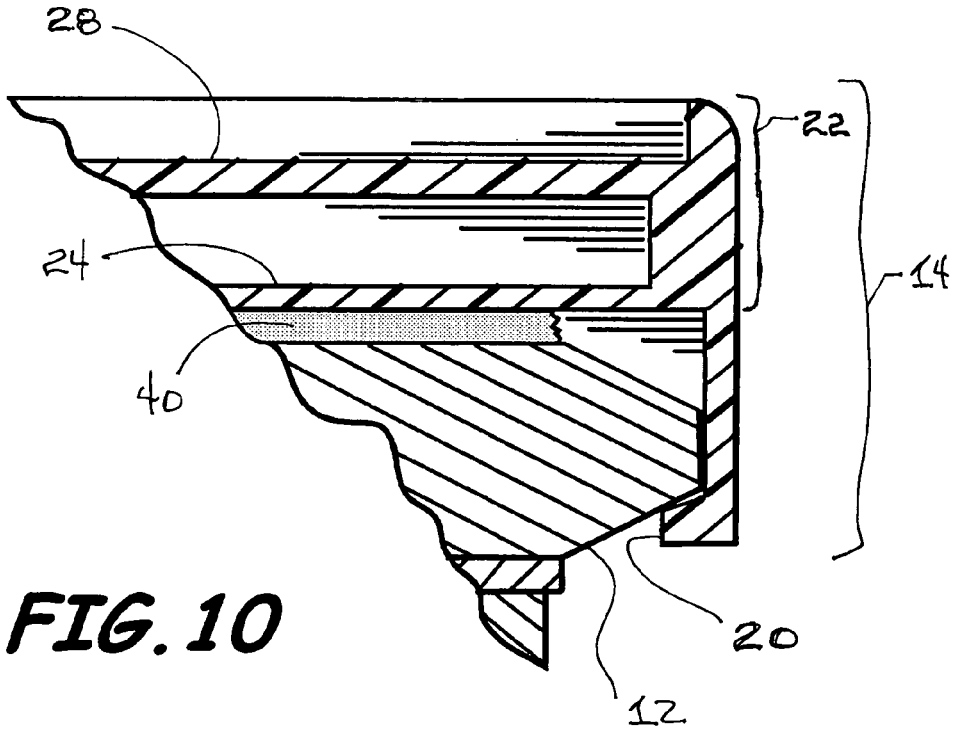
FIG. 10 is a partial cross sectional view of the caddy of FIG. 9, showing how the connector flange engages the flush valve housing.

As shown in FIGS. 1-10, a holder 10 adapted for mounting on a flush valve housing 12 comprises a body 14 having a lower portion and an upper portion. A connector 16 having a side wall 18 forming at least part of the lower portion of said body. The connector 16 is dimensioned to engage the flush valve housing 12 and preferably has a flange 20 adapted to make frictional contact therewith. As can be seen from the various figures, in the various embodiments of the invention the connector 16 matingly slips over the housing 12 of the flush valve. The holder 10 has a side wall 22 forming at least part of the upper portion of said body 14, said holder providing a receptacle in the upper portion of the body for holding an item. In this general embodiment, at least a first support 24 forms a division between said connector 16 and said holder 10 to support an item placed in said holder and one or more threaded fasteners 26 positioned on the lower portion of said body 14 to enhance the frictional contact. Those skilled in the art should understand that fasteners as employed in the present invention may include mechanical fasteners such as threaded fasteners but also may include a pad 40 of adhesive fastener such as that shown in FIGS. 4 and 9, as well as any other type of fastener effective for purposes of the invention. The adhesive fastener may instead be a pad 40 of resilient material, as seen in FIG. 4, so as to provide some soft frictional resistance. Preferably, the pad 40 may be both adhesive and resilient.

In a variation of the present holder 10, also called a beverage caddy, the body 14 is a generally cylindrical body with the upper portion forming the holder as a beverage caddy and the lower portion forming the connector 16. The first support is a first base 24 extending across a first diameter of said body 14 so as to separate the upper portion of said body from the lower portion. A second base 28 extends across a second diameter of said body 14 in the upper portion, spaced apart from the first base 22 and having a cutout 30 extending from an outer periphery of said body to at least a center of said second base. A first wall 22 extends upwardly along a periphery of the upper portion of said body, this first wall, the side wall of the caddy, has an opening 32 aligned with the cutout 30 in said second base 28 and extending upwardly along the wall. A second wall 18 extends downwardly along a periphery of the lower portion of said generally cylindrical body, said second wall dimensioned to form a cavity in the lower portion of said body wherein to receive a flush valve housing.

In yet another variation of the present invention, the beverage caddy 10 comprises a generally cylindrical body 14, the holder portion being a beverage holder or caddy having the side wall 22 forming a mouth and a cavity in the upper portion of said body, the holder having a holder flange 34 along an outer lower periphery. Separable curved or semicircular members 36 form the side wall 18 of said connector 16 and having a first connector flange 20 for engaging the holder flange 34 on said holder and having a second connector flange 38 for making frictional contact with the valve housing 12. A base 24 comprises said support positioned to form a floor for said holder 10. Optionally, the beverage caddy 10 may further comprise one or more fasteners 26 associated with said connector 16 to aid in enhancing the frictional contact.

In the embodiment shown in FIGS. 1-2, the present invention is expressed in a flush valve mounted beverage caddy 10 which includes a generally cylindrical body 14 having a lower portion and an upper portion. The beverage holder 10 has a side wall 22 forming a mouth and a cavity in the upper portion of said cylindrical body 14 and having a flange 34 along an outer lower periphery of said beverage holder. A connector 16 has separable curved 36 and preferably semicircular members associated with the lower portion of said cylindrical body 14, the connector preferably having a first flange 20 for engaging the flange on said beverage holder and a second flange 38 for making frictional contact with the valve housing. A base 24 is positioned between the connector 16 and the beverage holder or caddy 10, said base providing a support for a beverage container placed in said beverage holder. One or more fasteners 26 are associated with said connector to aid in enhancing the frictional contact.

The additional embodiment of the invention shown in FIGS. 3-10 and includes a flush valve 12 mounted beverage caddy 10 comprising a generally cylindrical body 14 having an upper portion defining a caddy for holding a beverage and having a lower portion defining a flush valve connector 16. A first base 24 extends across a diameter of said cylindrical body 14 separating the upper portion from the lower portion and a second base 28 extends across a diameter of the upper portion of said cylindrical body, said second base being spaced apart from said first base and having a cutout 30 extending from an outer periphery to a center of said second base. A first wall 22 extends upwardly along a periphery of the upper portion of said generally cylindrical body 14, said first wall having an opening 32 aligned with the cutout 30 in said second base and extending upwardly along the wall. A second wall 18 extends downwardly along a periphery of the lower portion of said generally cylindrical body 14, said second wall forming a cavity wherein to matingly receive a flush valve housing 12 and, preferably, one or more fasteners 26 are associated with said lower portion.

Accordingly, in the drawings and specification there have been disclosed typical preferred embodiments of the invention and, although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as recited in the appended claims.

What is claimed is:

1. A holder adapted for mounting on a flush valve housing, said holder comprising:

a body having a lower portion and an upper portion;

a connector having a side wall forming at least part of the lower portion of said body, said connector dimensioned to engage the flush valve housing and having a flange adapted to make frictional contact therewith;

a holder having a side wall forming at least part of the upper portion of said body, said holder providing a receptacle for holding an item;

at least a first support forming a division between said connector and said holder to support an item placed in said holder;

a second support extending along a second diameter of said body in the upper portion, above and spaced apart from said at least a first support and having a cutout extending from an outer periphery of said body to approximately a center of said second support; and one or more threaded fasteners positioned on the lower portion of said body to enhance the frictional contact.

2. The holder of claim 1, further comprising:

said body being a generally cylindrical body with the upper portion forming the holder as a beverage caddy and the lower portion forming the connector;

said at least first support extending across a first diameter of said body so as to at least partially separate the upper portion of said body from the lower portion;

a first wall extending upwardly along a periphery of the upper portion of said body, said first wall having an opening aligned with the cutout in said second support and extending upwardly along the wall; and a second wall extending downwardly along a periphery of the lower portion of said generally cylindrical body, said second wall dimensioned to form a cavity in the lower portion of said body wherein to receive the flush valve housing.

3. A flush valve mounted beverage caddy, said caddy comprising:

a generally cylindrical body having an upper portion defining a caddy for holding a beverage and having a lower portion defining a flush valve connector;

a first base extending across a diameter of said cylindrical body separating the upper portion from the lower portion;

a second base extending across a diameter of the upper portion of said cylindrical body, said second base being spaced apart from said first base and having a cutout extending from an outer periphery to a center of said second base;

a first wall extending upwardly along a periphery of the upper portion of said generally cylindrical body, said first wall having an opening aligned with the cutout in said second base and extending upwardly along the wall;

a second wall extending downwardly along a periphery of the lower portion of said generally cylindrical body, said second wall forming a cavity wherein to matingly receive a flush valve housing; and one or more fasteners associated with said lower portion.

* * * * *